US011114802B2

(12) United States Patent
Motomura

(10) Patent No.: US 11,114,802 B2
(45) Date of Patent: Sep. 7, 2021

(54) ELECTRICAL CONNECTOR AND LOCKING MEMBER

(71) Applicant: I-PEX Inc., Kyoto (JP)

(72) Inventor: Kazuki Motomura, Machida (JP)

( * ) Notice: Subject to any disclaimer, the term of this patent is extended or adjusted under 35 U.S.C. 154(b) by 0 days.

(21) Appl. No.: 16/853,765

(22) Filed: Apr. 21, 2020

(65) Prior Publication Data

US 2020/0343672 A1 Oct. 29, 2020

(30) Foreign Application Priority Data

Apr. 25, 2019 (JP) ..... JP2019-083850

(51) Int. Cl.

| | |
|---|---|
| ***H01R 13/639*** | (2006.01) |
| ***H01R 12/59*** | (2011.01) |
| ***H01R 12/70*** | (2011.01) |
| ***H01R 13/627*** | (2006.01) |
| *H01R 24/50* | (2011.01) |

(52) U.S. Cl.

CPC ..... *H01R 13/6395* (2013.01); *H01R 12/592* (2013.01); *H01R 12/7058* (2013.01); *H01R 13/6273* (2013.01); *H01R 13/6277* (2013.01); *H01R 24/50* (2013.01)

(58) Field of Classification Search

None

See application file for complete search history.

(56) References Cited

U.S. PATENT DOCUMENTS

| | | | |
|---|---|---|---|
| 2015/0004828 A1 | 1/2015 | Osada et al. | |
| 2016/0233611 A1 | 8/2016 | Sato | |
| 2018/0212363 A1* | 7/2018 | Fukumoto ..... | H01R 13/7031 |

FOREIGN PATENT DOCUMENTS

| | | |
|---|---|---|
| CN | 2852450 | 12/2006 |
| CN | 104283065 | 1/2015 |
| CN | 105870696 | 8/2016 |
| CN | 106972329 | 7/2017 |
| CN | 208571108 | 3/2019 |
| EP | 3352306 | 7/2018 |
| JP | H2-299180 | 12/1990 |
| JP | 6135834 | 5/2017 |
| JP | 2018-116908 | 7/2018 |
| JP | 2019-096580 | 6/2019 |

* cited by examiner

*Primary Examiner* — Ross N Gushi

(74) *Attorney, Agent, or Firm* — Soei Patent & Law Firm

(57) ABSTRACT

An electrical connector includes a plug connector and a locking member. The plug connector has a fitting portion, and an outer diameter of the fitting portion is configured to be able to be expanded. The locking member includes a pair of arm portions configured to restrict expansion of a diameter of the fitting portion by sandwiching the fitting portion from outward in a radial direction when the fitting portion fitted to a ground contact member is removed, and a positioning portion configured to curb movement of the plug connector in a Y direction in a restricted state in which the pair of arm portions restrict the expansion of the diameter of the fitting portion. In the restricted state, the positioning portion faces a first fixing portion located rearward from the fitting portion in the Y direction, and curbs movement of the first fixing portion in the Y direction.

20 Claims, 8 Drawing Sheets

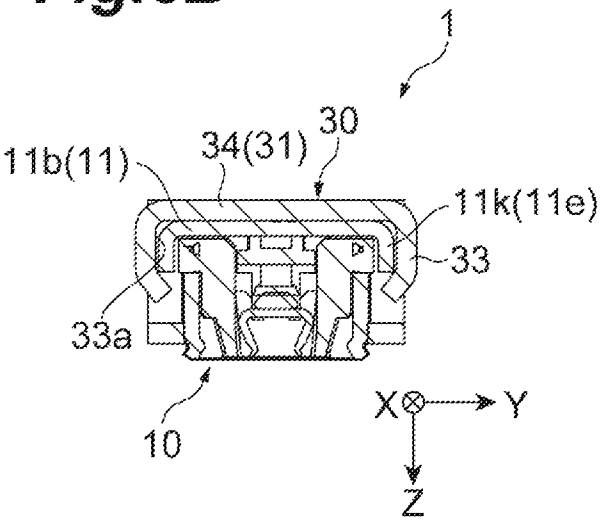
Fig.6B
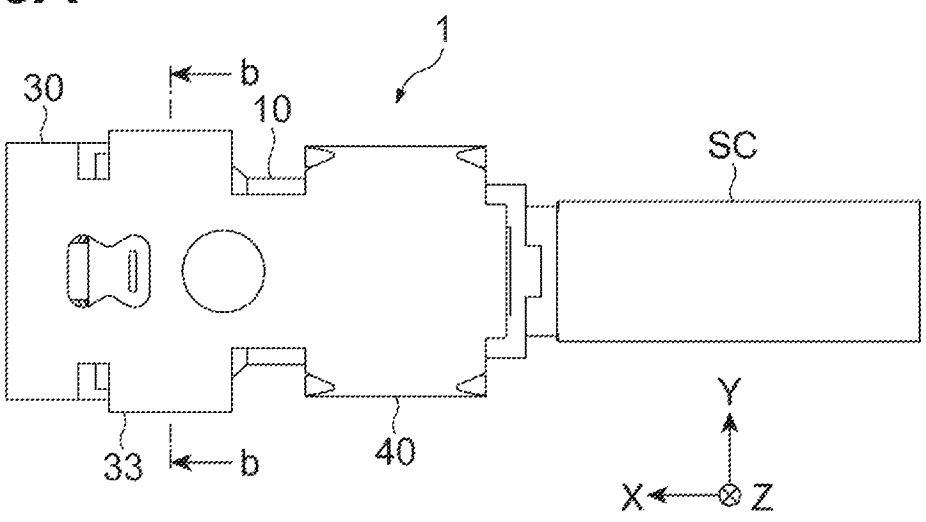
Fig.6A
Fig.6D
Fig.6C

ELECTRICAL CONNECTOR AND LOCKING MEMBER

CROSS-REFERENCE TO RELATED APPLICATION

This application is based upon and claims the benefit of priority from Japanese Patent Application No. 2019-083850, filed on Apr. 25, 2019, the entire contents of which are incorporated herein by reference.

TECHNICAL FIELD

The present disclosure relates to an electrical connector, a method for manufacturing the same, and a locking member.

BACKGROUND

In an electrical connector, it is important to maintain a firm fitted state with respect to a mating connector to be electrically connected. Patent Document 1 (Japanese Patent No. 6135834) discloses an electrical connector having a locking member which maintains a firm fitted state with respect to a mating connector.

The locking member described in Patent Document 1 maintains the fitted state by restricting expansion of a diameter of a fitting portion of a connector fitted to a mating connector by a pair of arm portions. Such a pair of arm portions has extending portions which are continuous with a portion which restricts the expansion of the diameter of the fitting portion. It is possible to curb movement of the connector in a connector width direction which is a direction in which the pair of arm portions face each other by providing the extending portions and thus to curb separation of the locking member from the connector.

Here, as a height of the connector is reduced, a size of the locking member is also required to be further reduced. The present disclosure has been made in view of the above circumstances, and an object thereof is to reduce a size of a locking member while separation of the locking member, which maintains a fitted state, from a connector is curbed.

SUMMARY

An electrical connector according to the present disclosure includes a first connector mounted on a tip end of a cable, and a locking member mounted on the first connector, wherein the first connector includes a conductive first contact electrically connected to a contact of a second connector which is a mating connector, the first contact has a cylindrical fitting portion fitted to the contact of the second connector, an outer diameter of the fitting portion is configured to be able to be expanded when the fitting portion is inserted into or removed from the contact of the second connector, the locking member includes a pair of arm portions configured to restrict expansion of a diameter of the fitting portion by sandwiching the fitting portion from outward in a radial direction when the fitting portion fitted to the contact of the second connector is removed, and a positioning portion configured to curb movement of the first connector in a connector width direction in which the pair of arm portions face each other in a restricted state in which the pair of arm portions restrict the expansion of the diameter of the fitting portion, and in the restricted state, the positioning portion faces a rear portion of the first connector located rearward from the fitting portion, which is a direction from the tip end of the cable toward a base end of the cable, in the connector width direction, and curbs movement of the rear portion in the connector width direction.

In the electrical connector according to the present disclosure, the pair of arm portions of the locking member is configured to be able to restrict the expansion of the outer diameter of the fitting portion. Thus, the expansion of the diameter of the fitting portion after fitting with the second connector is curbed, and a fitted state between the first connector and the second connector can be thinly maintained. Further, in the electrical connector according to the present disclosure, in the restricted state in which the expansion of the diameter of the fitting portion is restricted, the positioning portion of the locking member faces the rear portion of the connector in the connector width direction and curbs the movement of the rear portion in the connector width direction. Separation of the locking member from the connector can be curbed by curbing the movement of the rear portion. Additionally, conventionally, the movement of the first connector in the connector width direction has been curbed by extending the pair of arm portions (having an extending portion in addition to a portion which restricts the expansion of the diameter). On the other hand, in the electrical connector according to the present disclosure, such an extending portion is not provided, and a positioning portion which faces the rear portion of the connector is provided separately from the pair of arm portions. Since the extending portions of the pair of arm portions which are conventionally required are not provided, a configuration around the pair of arm portions can be simplified, and a size of the locking member can be reduced.

The rear portion may be a fixing portion made of a metal and configured to fix the first connector to the cable. With such a configuration, for example, the positioning portion of the locking member made of a metal or the like and the fixing portion made of a metal face each other, and when the positioning portion comes into contact with the fixing portion to correct a position of the fixing portion (to curb the movement in the connector width direction), it is possible to secure a contact strength.

The locking member may be mounted on the first connector to allow mutual movement between a position of the restricted state and a position in a standby state in which the pair of arm portions do not restrict the expansion of the diameter of the fitting portion, and the positioning portion may come into contact with a part of the first connector when the locking member moves in a moving direction, and curbs further movement of the locking member in the moving direction. Accordingly, when the locking member is moved in switching between the restricted state and the standby state, it is possible to curb the separation of the locking member from the connector.

The positioning portion may face the rear portion in the connector width direction even in a standby state in which the pair of arm portions do not restrict the expansion of the diameter of the fitting portion, and may curb movement of the rear portion in the connector width direction. With such a configuration, in any of the restricted state and the standby state, the separation of the locking member from the connector can be curbed.

The locking member may be mounted on the first connector to allow mutual movement between a position of the restricted state and a position in a standby state in which the pair of arm portions do not restrict the expansion of the diameter of the fitting portion, and in the position of the standby state, tip ends of the pair of arm portions may not go beyond a center of the fitting portion in a moving direction of the locking member. With such a configuration, when compared with a conventional configuration in which the pair of arm portions extend rearward, a length of the pair of arm portions can be reduced, and the size of the locking member can be reduced.

the locking member may be mounted on the first connector to allow mutual movement between a position of the restricted state and a position in a standby state in which the pair of arm portions do not restrict the expansion of the diameter of the fitting portion, the first connector may have a rail portion configured to extend in a moving direction of the locking member and to assist movement of the locking member, and a surface of the positioning portion which faces the rear portion may be located inward in the connector width direction from an outer surface of the rail portion in the connector width direction. With such a configuration, the positioning portion can be provided near the rear portion (close to the rear portion) in the connector width direction, and the movement of the rear portion in the connector width direction can be curbed more effectively.

A method for manufacturing an electrical connector according to the present disclosure is a method for manufacturing the above-described electrical connector including a first step of mounting the locking member on the first connector, and a second step of bending the positioning portion so that the positioning portion faces the rear portion in the connector width direction after the first step. For example, in the case in which the locking member of which the positioning portion is bent from the beginning is mounted on the first connector, it is necessary for the positioning portion (or the surroundings thereof) to have sufficient spring characteristics to be able to be mounted. However, a locking member having good spring characteristics may come off the first connector when, for example, a strong external force is applied. On the other hand, in the case in which the positioning portion is bent after the locking member is mounted on the first connector to form a structure in which the locking member does not come off, as in the above-described manufacturing method, since it is not necessary to use a locking member having good spring characteristics as described above, it is possible to curb the locking member coming off the first connector even when an external force or the like is applied.

A locking member according to the present disclosure is a locking member mounted on a first connector mounted on a tip end of a cable, including a pair of arm portions configured to restrict expansion of a diameter of a cylindrical fitting portion by sandwiching the fitting portion from outward in a radial direction when the fitting portion of the first connector fitted to a contact of a second connector which is a mating connector is removed, and a positioning portion configured to curb movement of the first connector in a connector width direction in which the pair of arm portions face each other in a restricted state in which the pair of arm portions restrict the expansion of the diameter of the fitting portion, wherein, in the restricted state, the positioning portion faces a rear portion of the first connector located rearward from the fitting portion, which is a direction from the tip end of the cable toward a base end of the cable, in the connector width direction, and curbs movement of the rear portion in the connector width direction.

According to the present disclosure, a size of a locking member can be reduced, while separation of the locking member, which maintains a fitted state, from a connector is curbed.

BRIEF DESCRIPTION OF THE DRAWINGS

FIGS. 2A, 2B, 2C and 2D are views showing a plug connector included in the electrical connector of FIG. 1, wherein FIG. 2A is a perspective view, FIG. 2B is a side view, FIG. 2C is a cross-sectional view taken along line c-c of FIG. 2B, and FIG. 2D is a bottom view.

FIGS. 3A, 3B, 3C and 3D are views showing a locking member included in the electrical connector of FIG. 1, wherein FIG. 3A is a perspective view, FIG. 3B is a plan view, FIG. 3C is a side view, and FIG. 3D is a bottom view.

FIGS. 4A and 4B are views showing the locking member before and after bending of a positioning portion, wherein FIG. 4A shows the locking member before bending of the positioning portion, and FIG. 4B shows the locking member after bending of the positioning portion.

FIGS. 5A and 5B are perspective views of the electrical connector, wherein FIG. 5A is a top perspective view and FIG. 5B is a bottom perspective view.

FIGS. 6A, 6B, 6C and 6D are views showing the electrical connector on which the locking member is mounted, wherein FIG. 6A is a plan view, FIG. 6B is a cross-sectional view taken along line b-b of FIG. 6A, FIG. 6C is a side view, and FIG. 6D is a rear view.

FIG. 7B is a bottom view showing the electrical connector in a restricted state (after restriction).

FIGS. 8A, 8B, 8C and 8D are views showing the electrical connector at the time of fitting with a receptacle connector, wherein FIG. 8A is a perspective view, FIG. 8B is a side view, FIG. 8C is a cross-sectional view taken along line c-c of FIG. 8B, and FIG. 8D is a cross-sectional view taken along line d-d of FIG. 8B.

DETAILED DESCRIPTION

Embodiments according to the present disclosure which will be described below are exemplifications for describing the present invention, and thus the present invention should not be limited to the following contents. In the following description, the same elements or elements having the same functions will be designated by the same reference symbols, and redundant description thereof will be omitted.

[Outline of Electrical Connectors]

Figure 1:
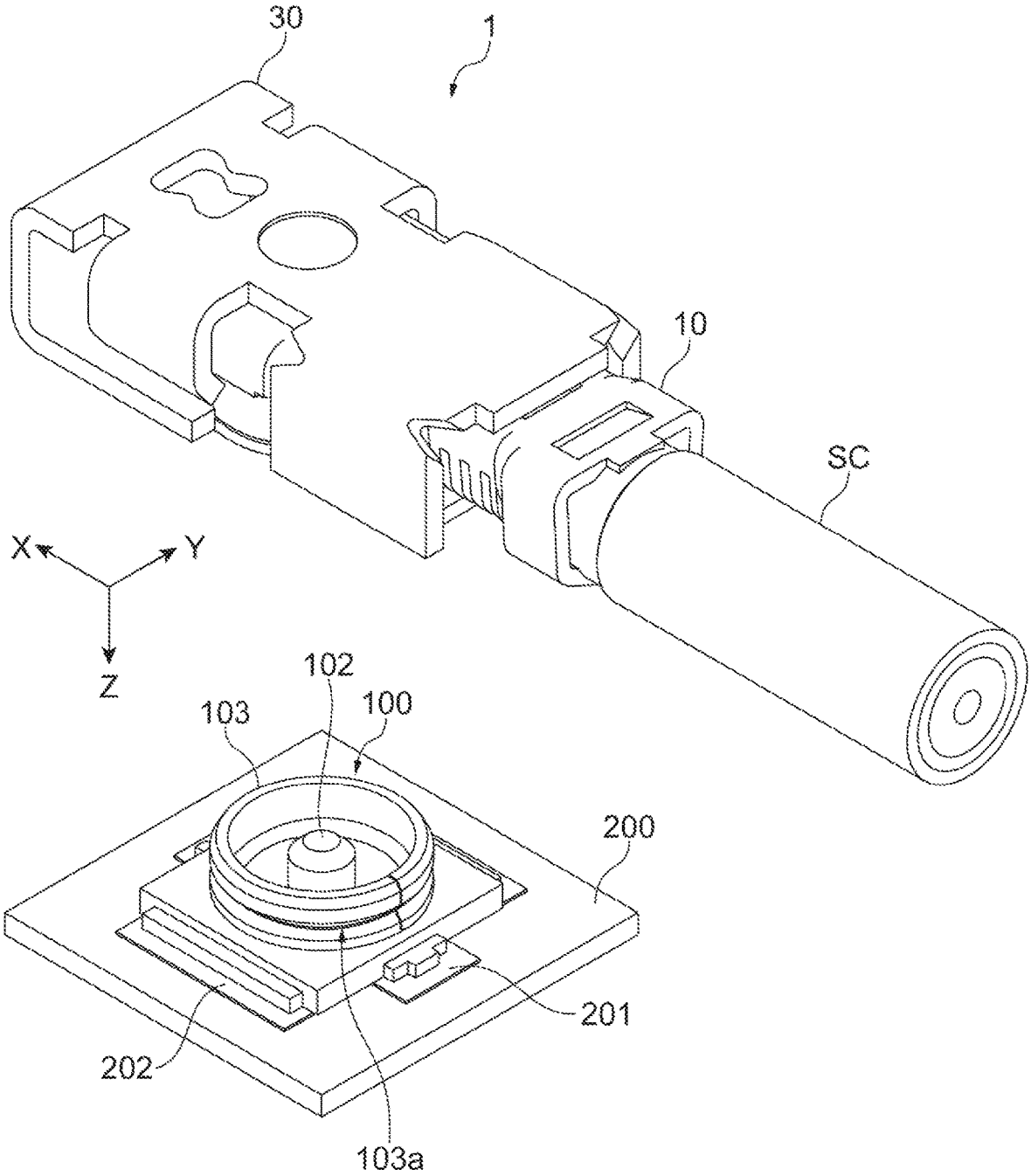
FIG. 1 is a perspective view of an electrical connector according to an embodiment of the present invention.

An outline of an electrical connector will be described with reference to FIG. 1. As shown in FIG. 1, the electrical connector 1 includes a plug connector 10 (a first connector) and a locking member 30. The electrical connector 1 is a connector which electrically connects a cable-like signal transmission medium to an electric circuit on a substrate, and is, for example, a radio frequency (RF) connector. The signal transmission medium is a medium which transmits signals of various electronic devices such as a mobile phone and is, for example, a coaxial cable SC. The substrate is, for example, a printed wiring board 200. That is, the electrical connector 1 of the embodiment is a coaxial electrical connector which electrically connects the coaxial cable SC to the electric circuit of the printed wiring board 200. In the electrical connector 1, the coaxial cable SC and the electric circuit of the printed wiring board 200 are electrically connected to each other by the plug connector 10 mounted on a terminal portion of the coaxial cable SC being fitted to a receptacle connector 100 (a second connector) which is a mating connector mounted on the printed wiring board 200.

In the following description, an axial direction of the coaxial cable SC may be referred to as an "X direction", and a fitting direction of the plug connector 10 and the receptacle connector 100 when the plug connector 10 and the receptacle connector 100 are fitted may be referred to as a "Z direction", and a direction orthogonal to the X direction and the Z direction may be referred to as a "Y direction". Further, in the X direction, an end portion of the coaxial cable SC on which the plug connector 10 is mounted may be referred to as a "tip end", and an opposite end portion may be referred to as a "rear end" (a base end). Therefore, a direction from the tip end to the base end of the coaxial cable SC may be described as "rearward". Furthermore, in the Z direction, for example, the plug connector 10 side in a state shown in FIG. 1 may be referred to as "upper", and the receptacle connector 100 side may be referred to as "lower".

[Plug Connector]

Next, details of the plug connector 10 will be described with reference to FIGS. 2A to 2D. The plug connector 10 is a connector mounted on a tip end portion (one end) of the coaxial cable SC. As shown in FIGS. 2A to 2D, the plug connector 10 includes a conductive outer conductor shell 11 (a first contact), an insulating housing 12 having insulating properties, and an inner conductor contact 13. Hereinafter, the coaxial cable SC on which the plug connector 10 is mounted, and the outer conductor shell 11, the insulating housing 12, and the inner conductor contact 13 which constitute the plug connector 10 will be described in detail.

(Coaxial Cable)

The coaxial cable SC is a wiring used in a small terminal such as a mobile phone to transmit a high-frequency signal between various signal processing elements (for example, an antenna, a control chip for controlling the antenna, a board, and the like) built into the small terminal. The coaxial cable SC includes an inner conductor SC1 (refer to FIG. 2C), an insulator provided around the inner conductor SC1, an outer conductor provided around the insulator, and a protective film provided around the outer conductor. In the coaxial cable SC, the outer conductor, the insulator, and the inner conductor SC1 are exposed stepwise in that order toward the tip end on which the plug connector 10 is mounted.

In the embodiment, a signal transmission circuit is configured by the inner conductor SC1 being electrically connected via the inner conductor contact 13 to a signal contact member 102 (refer to FIG. 1) of the receptacle connector 100 connected to a signal terminal 201 of the printed wiring board 200. Further, a ground circuit is configured by the outer conductor of the coaxial cable SC being electrically connected via the outer conductor shell 11 to a ground contact member 103 (refer to FIG. 1) of the receptacle connector 100 connected to a ground terminal 202 of the printed wiring board 200.

(Outer Conductor Shell)

Figure 2B:
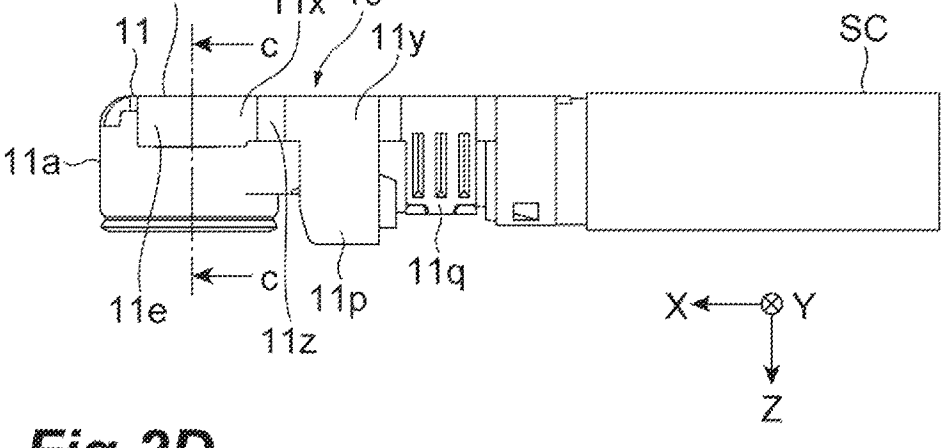
Figure 2D:
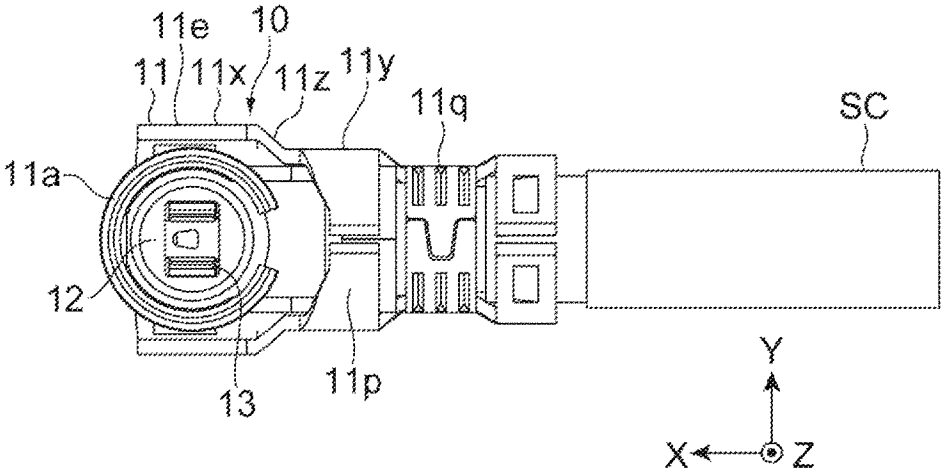

The outer conductor shell 11 is a conductive ground contact member which is electrically connected to the outer conductor of the coaxial cable SC. The outer conductor shell 11 is provided to cover the periphery of the insulating housing 12 as shown in FIG. 2D. The outer conductor shell 11 is electrically connected to the ground contact member 103 (a contact, refer to FIG. 1) of the receptacle connector 100 (the second connector) which is a mating connector and thus constitutes the ground circuit. The outer conductor shell 11 is formed of, for example, a thin metal member. The outer conductor shell 11 has a fitting portion 11*a*, a lid portion 11*b*, a rail portion 11*e*, a first fixing portion 11*p* (a rear portion), and a second fixing portion 11*q*.

The fitting portion 11*a* is formed in a cylindrical shape (tubular shape) of which an axial direction is the Z direction and accommodates the insulating housing 12 coaxially in a cylindrical hole thereof. An inner peripheral surface of the fitting portion 11*a* is close to an outer peripheral surface of the insulating housing 12. A protruding portion 11*c* which protrudes radially inward (in a direction toward a center of the cylindrical shape of the fitting portion 11*a*) over the entire circumference thereof is provided near a lower end of the fitting portion 11*a* (refer to FIG. 2C). The fitting portion 11*a* is fitted to the ground contact member 103 (refer to FIG. 1) of the receptacle connector 100 by the protruding portion 11*c* engaging with a concave portion 103*a* (refer to FIG. 1) formed on the outer periphery of the ground contact member 103 of the receptacle connector 100. The fitting portion 11*a* is configured so that an outer diameter thereof be expanded when the receptacle connector 100 is inserted into or removed from the ground contact member 103. The outer diameter of the fitting portion 11*a* in a state in which the diameter is not expanded is, for example, about 2.5 mm, and the outer diameter in a state in which the diameter is expanded is, for example, about 2.7 mm. The fitting portion 11*a* can be inserted into and removed from the ground contact member 103 only after the diameter is expanded, and cannot be inserted into or removed from the ground contact member 103 when the diameter not expanded.

Figure 2A:
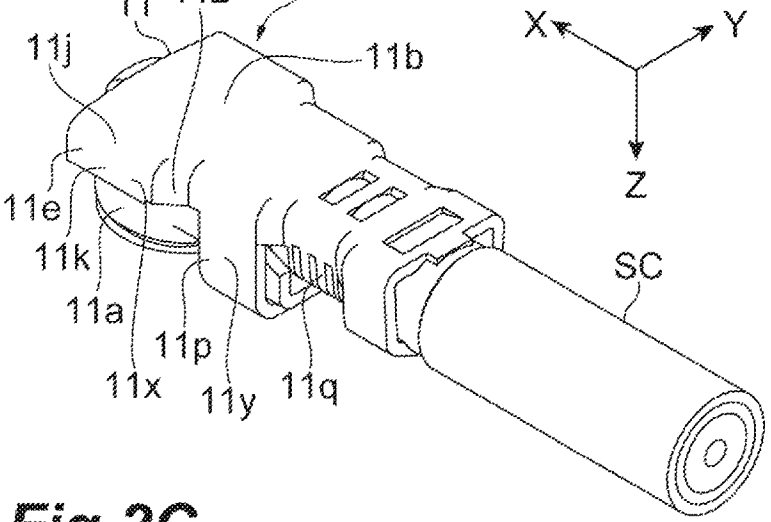

As shown in FIG. 2A, the lid portion 11*b* is a portion which covers an upper opening of the fitting portion 11*a* to close the upper opening. The lid portion 11*b* is provided integrally with the fitting portion 11*a*. The rail portion 11*e* which extends in the X direction is provided on the lid portion 11*b*. The rail portion 11*e* is provided integrally with the lid portion 11*b* and extends in the X direction. The rail portion 11*e* is provided on substantially the entire length of the lid portion 11*b* in the X direction. The rail portion 11*e* is provided at both ends of the lid portion 11*b* in the Y direction. As shown in FIG. 2A, the rail portion 11*e* includes a connection portion 11*j* which is a connection portion with the lid portion 11*b*, and a wall portion 11*k* which is continuous with the connection portion 11*j* and extends in the Z direction (the fitting direction). The wall portion 11*k* is a portion which comes into contact the locking member 30 and assists movement of the locking member 30 when a guide portion 33 (which will be described later) of the locking member 30 slides (refer to FIG. 6B).

As shown in FIG. 2A, the first fixing portion 11*p* is a fixing portion which is made of a metal and located behind the lid portion 11*b* (that is, behind the fitting portion 11*a*) to be continuous with the lid portion 11*b* and mounts the plug connector 10 on the coaxial cable SC. The first fixing portion 11*p* is provided along the coaxial cable SC. The first fixing portion 11*p* is a plate-like member which is configured to be bendable and formed to have a U-shape in a state before it is bent. As shown in FIG. 2D, an outer wall surface 11*y* of the first fixing portion 11*p* which is an outer surface in the Y direction is located inward from an outer wall surface 11*x* of the rail portion 11*e* in the Y direction which is an outer surface in the Y direction. As shown in FIG. 2A, the outer wall surface 11*x* and the outer wall surface 11*y* are continuous via a connection portion 11*z*.

As shown in FIG. 2A, the second fixing portion 11*q* is a fixing portion which is made of a metal and located behind the first fixing portion 11*p* to be continuous with the first fixing portion 11*p* and mounts the plug connector 10 to the coaxial cable SC. The second fixing portion 11*q* is provided along the coaxial cable SC. The second fixing portion 11*q* is a plate-like member which is configured to be bendable and is formed to have a U-shape in a state before it is bent. The second fixing portion 11*q* is fixed to the coaxial cable SC by being bent to cover the outer conductor of the coaxial cable SC and the outer periphery of the protective film and mounts the plug connector 10 on the coaxial cable SC.

(Insulating Housing)

Figure 2C:
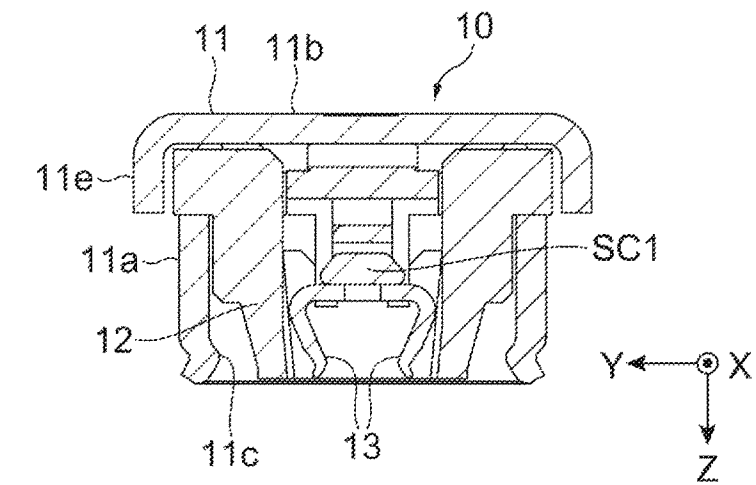

The insulating housing 12 is an insulator which is formed in a cylindrical shape, holds the inner conductor contact 13 inside and insulates between the outer conductor shell 11 and the inner conductor contact 13 (refer to FIG. 2C). An outer peripheral surface of the insulating housing 12 is close to the inner peripheral surface of the fitting portion 11*a*.

(Inner Conductor Contact)

The inner conductor contact 13 is mounted to the inside of the insulating housing 12 by press-fitting or the like. The inner conductor contact 13 includes a connection portion which connects the inner conductor SC1 of the coaxial cable SC, and a pair of contact portions which extend from the connection portion in the Z direction (the fitting direction) and is electrically connected to the inner conductor SC1 (FIG. 2C). The inner conductor contact 13 is configured to be elastically displaceable in the Z direction and comes into contact with the signal contact member 102 (refer to FIG. 1) of the receptacle connector 100.

[Locking Member]

Next, details of the locking member 30 will be described with reference to FIGS. 3A to 3D. The locking member 30 is mounted on the plug connector 10. The locking member 30 firmly maintains a fitted state between the plug connector 10 and the receptacle connector 100 by restricting the expansion of the outer diameter of the fitting portion 11*a* of the plug connector 10 after the plug connector 10 and the receptacle connector 100 are fitted to each other. The locking member 30 is mounted on the plug connector 10 to be movable between a position (a restriction position) in a restricted state in which a pair of arm portions 37 and 38 restrict the expansion of the diameter of the fitting portion 11*a* and a position (a standby position) in a standby state in which the pair of arm portions 37 and 38 do not restrict the expansion of the diameter of the fitting portion 11*a*. The locking member 30 has a main body portion 31, a restriction portion 32, a guide portion 33, and a positioning portion 40. The locking member 30 is formed of, for example, a thin metal member.

(Main Body Portion)

The main body portion 31 is a portion which partially covers the lid portion 11*b* and is movable along the lid portion 11*b*. The main body portion 31 has a flat plate portion 34 and a connection portion 35. The flat plate portion 34 is a substantially rectangular flat plate which is provided to cover the lid portion 11*b* of the outer conductor shell 11. The flat plate portion 34 faces the pair of arm portions 37 and 38 in the Z direction and holds the guide portion 33 and the positioning portion 40. The flat plate portion 34 has an opening 34*a* which passes therethrough in the Z direction. The opening 34*a* is formed at a position in which the lid portion 11*b* can be seen, and a state of the locking member 30 (whether the state is the restriction state or the standby state) can be confirmed by an appearance of the lid portion 11*b* through the opening 34*a*. Therefore, the opening 34*a* is formed closer to a tip end of the flat plate portion 34 than a central portion thereof in the X direction. An operation portion 34*b* which protrudes upward or is recessed downward from other portions of the flat plate portion 34 is provided behind the opening 34*a* in the flat plate portion 34 in the X direction. Since the operation portion 34*b* is provided, operability when the locking member 30 is slid is improved. The connection portion 35 is a portion which extends in the Z direction to connect the tip end of the flat plate portion 34 in the X direction and tip ends of the pair of arm portions 37 and 38 in the X direction.

(Restriction Portion)

The restriction portion 32 is a portion configured to be capable of restricting the expansion of the diameter of the fitting portion 11*a*. More specifically, the restriction portion 32 is configured to be capable of restricting the expansion of the fitting portion 11*a* to maintain an engaged state between the concave portion 103*a* of the ground contact member 103 and the protruding portion 11*c* of the fitting portion 11*a* when the fitting portion 11*a* fitted to the ground contact member 103 (refer to FIG. 1) of the receptacle connector 100 is removed. The restriction portion 32 faces the flat plate portion 34 in the Z direction and extends parallel to the flat plate portion 34 in the X direction. As shown in FIG. 3D, the restriction portion 32 has a tip end portion 36 which is continuous with the connection portion 35 and a pair of arm portions 37 and 38 which are continuous with the tip end portion 36. The restriction portion 32 restricts the expansion of the diameter of the fitting portion 11*a* in a state in which the fitting portion 11*a* is located in a region (an enclosed region) defined by the tip end portion 36 and the pair of arm portions 37 and 38 (refer to FIG. 7B).

The tip end portion 36 is a portion which comes into contact with the tip end portion of the fitting portion 11*a* in the X direction and positions the fitting portion 11*a* when the expansion of the diameter of the fitting portion 11*a* is restricted (a portion in which the locking member 30 is positioned at a restriction position described later with respect to the plug connector 10). The tip end portion 36 has a shape corresponding to the cylindrical shape to come into contact with the cylindrical fitting portion 11*a* in a wide range.

The pair of arm portions 37 and 38 are connected to the main body portion 31 via the tip end portion 36 and restrict the expansion of the diameter of the fitting portion 11*a* by sandwiching the fitting portion 11*a* from outward in the radial direction (the Y direction) when the fitting portion 11*a* is removed. The pair of arm portions 37 and 38 face each other in the Y direction. The arm portion 37 extends in the X direction to be continuous with one end of the tip end portion 36 in the Y direction. The arm portion 38 extends in the X direction to be continuous with the other end of the tip end portion 36 in the Y direction. A distance between the pair of arm portions 37 and 38 is smaller than the outer diameter of the fitting portion 11*a* in a state in which the diameter is expanded and is, for example, substantially equal to the outer diameter of the fitting portion 11*a* in a state in which the diameter is not expanded. In the embodiment, the "outer diameter of the fitting portion 11*a*" refers to an outer diameter of the fitting portion 11*a* having the same height (the same position in the Z direction) as the pair of arm portions 37 and 38 in a state in which the locking member 30 is mounted on the plug connector 10.

Figure 7B:
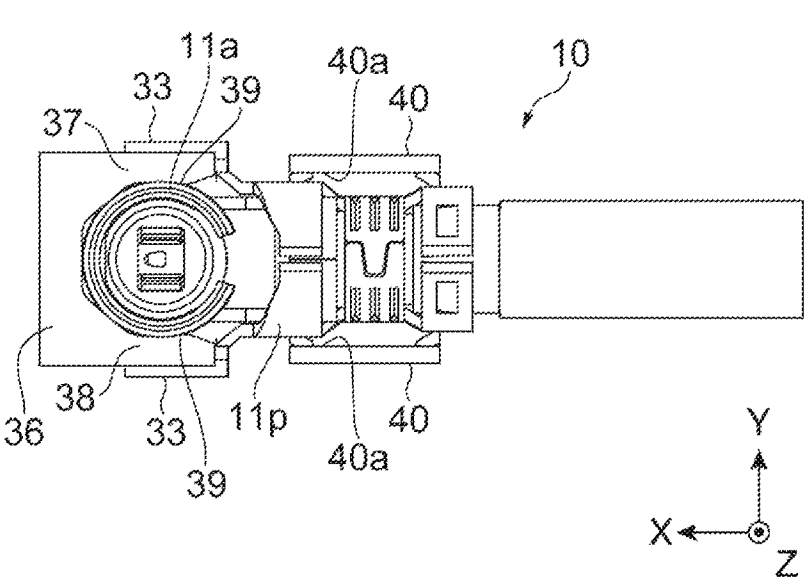
FIGS. 7A and 7B are bottom views showing the electrical connector before and after restriction of expansion of a diameter of a fitting portion, wherein 7A is a bottom view showing the electrical connector in a standby state (before restriction)
Figure 7A:
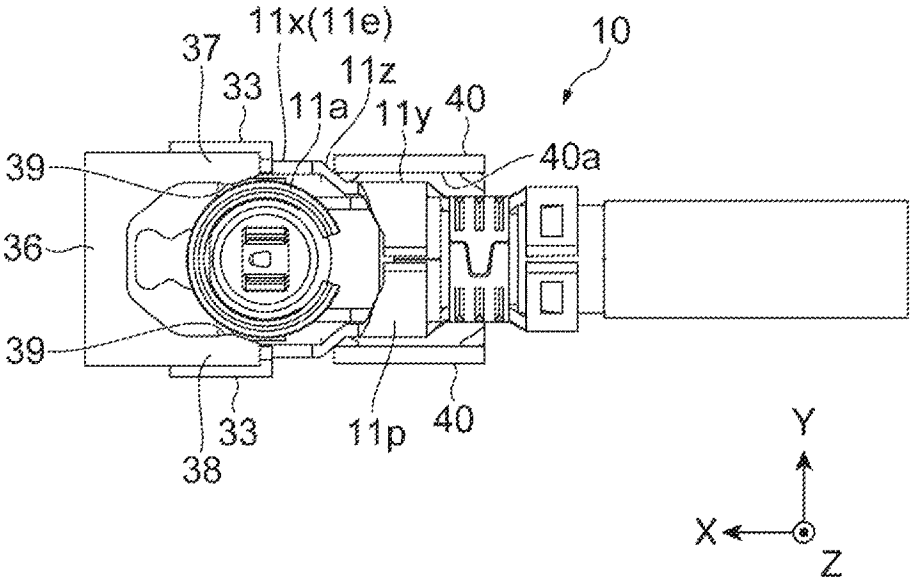

Lengths of the pair of arm portions 37 and 38 in the X direction are substantially the same. The tip ends of the pair of arm portions 37 and 38 are located in front of the center of the fitting portion 11*a* in the X direction at a standby position described later, for example, as shown in FIG. 7A. The tip ends do not go beyond the center. These lengths of the pair of arm portions 37 and 38 are an example, and the lengths of the pair of arm portions 37 and 38 in the X direction are not limited as long as the expansion of the diameter of the fitting portion 11*a* can be restricted.

Figure 8A:
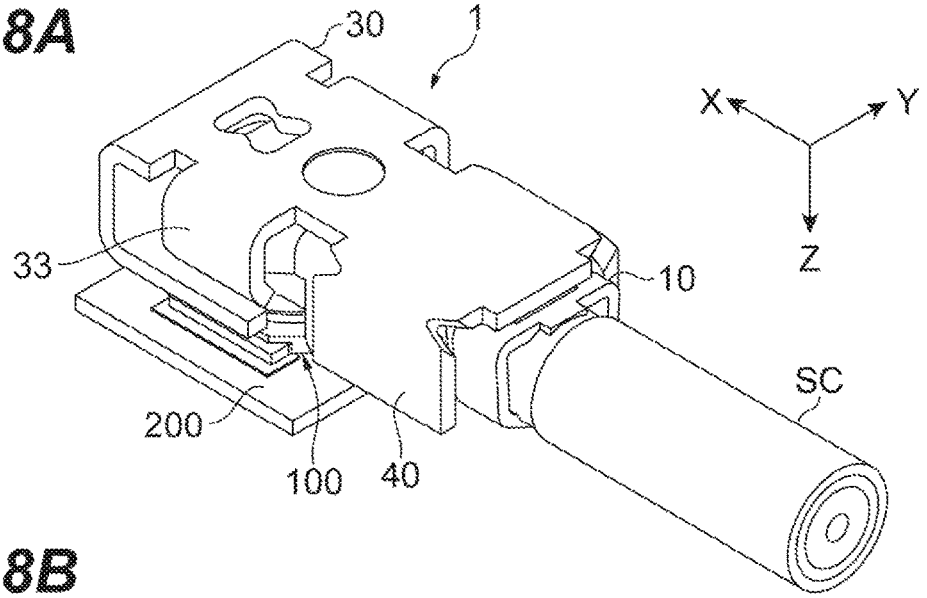
Figure 8B:
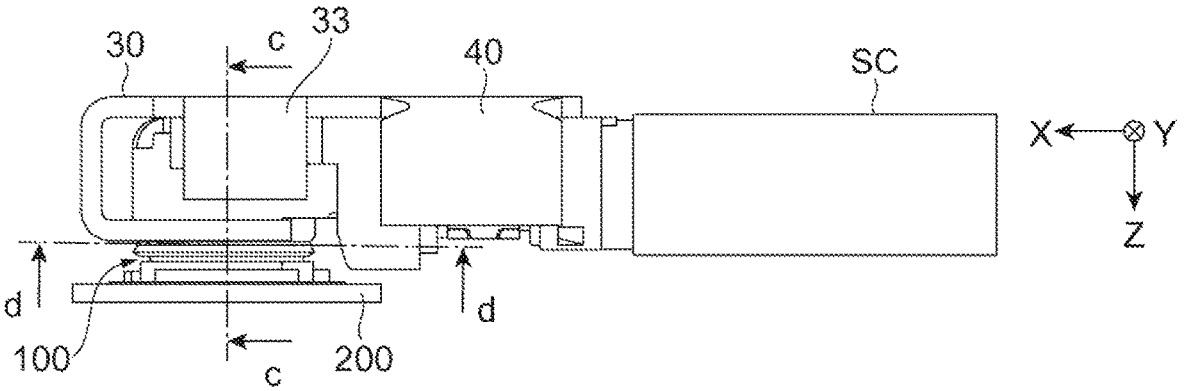
Figure 8C:
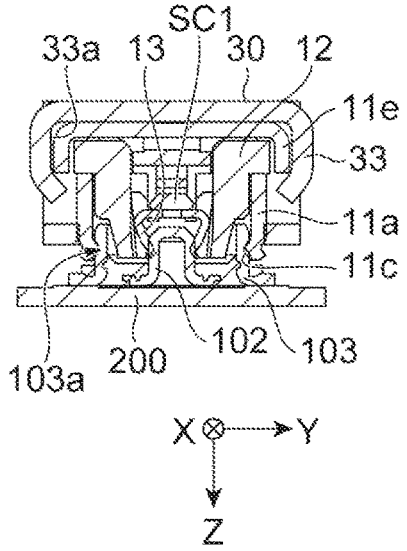
Figure 8D:
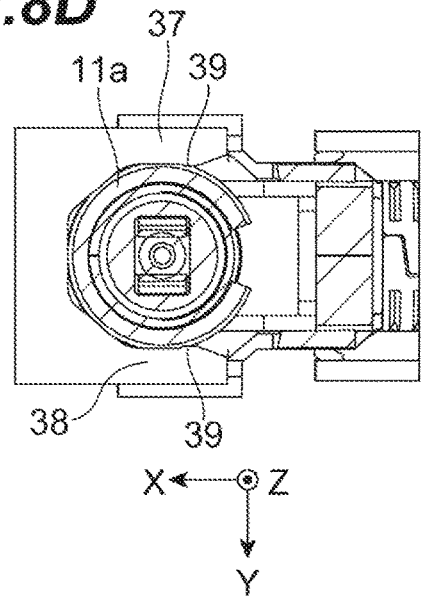

A protruding portion 39 which protrudes toward one arm of the pair of arm portions 37 and 38 which faces the other is provided at at least the other of the pair of arm portions 37 and 38. In the embodiment, as shown in FIG. 3D, the protruding portion 39 is provided on both of the pair of arm portions 37 and 38. As shown in FIGS. 7B and 8D, the distance between the pair of arm portions 37 and 38 at the positions in which the protruding portions 39 are provided is shorter than the outer diameter of the fitting portion 11*a*.

Accordingly, when the locking member 30 moves from the standby position to the restriction position, the portions of the pair of arm portions 37 and 38 in which the protruding portions 39 are provided need to get over the fitting portion 11*a* having an outer diameter larger than the distance between the pair of arm portions 37 and 38. When the protruding portions 39 get over the fitting portion 11*a*, an operator who operates the locking member 30 can get a feeling of getting over (vibration) or a sound when getting over, that is, a so-called click feeling. In the embodiment, the pair of arm portions 37 and 38 have elasticity, and thus it is possible to reliably ensure that the protruding portions 39 get over the fitting portion 11*a*.

The protruding portions 39 are located rearward from the center of the fitting portion 11*a* in a state (a state shown in FIGS. 7B and 8D) in which the movement from the standby position to the restriction position is completed by the locking member 30 moving rearward with respect to the fitting portion 11*a*.

(Guide Portion)

The guide portion 33 is a portion which guides the movement of the restriction portion 32 with respect to the fitting portion 11*a*. Guiding the movement includes not only guiding the movement to a certain region, but also preventing deviation from the certain region. The guide portion 33 guides the movement of the restriction portion 32 in the axial direction (the X direction) of the coaxial cable SC which is a direction intersecting the fitting direction (the Z direction) of the fitting portion 11*a*. The guide portion 33 guides the restriction portion 32 so that the restriction portion 32 can move between the restriction position (refer to FIG. 7B) in which the expansion of the diameter of the fitting portion 11*a* is restricted and the standby position (refer to FIG. 7A) in which the restricting is not performed. As described above, the restriction position and the standby position are positions of the restriction portion 32 relative to the fitting portion 11*a*.

Figure 3B:
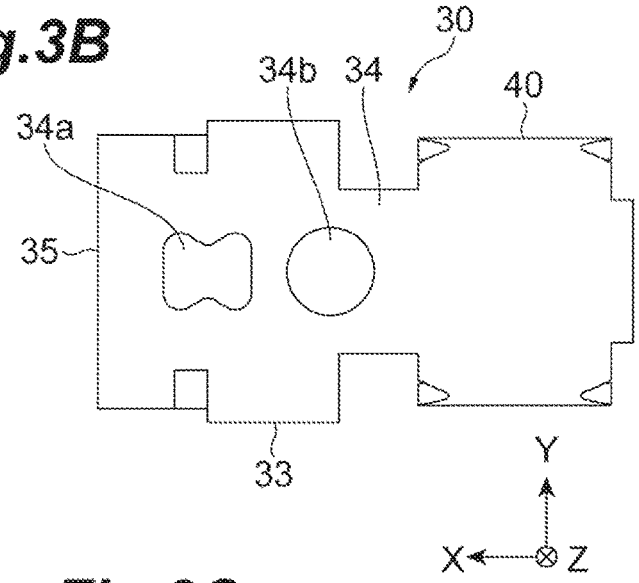
Figure 3A:
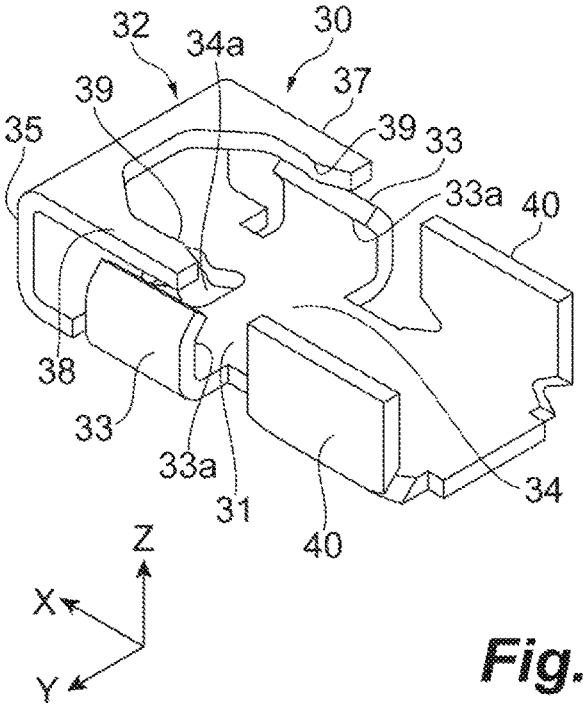
Figure 3C:
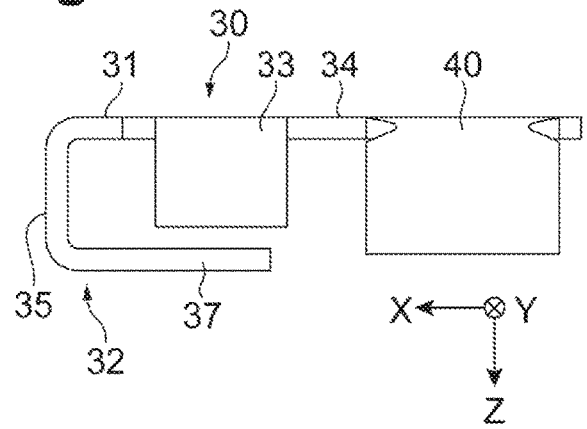
Figure 3D:
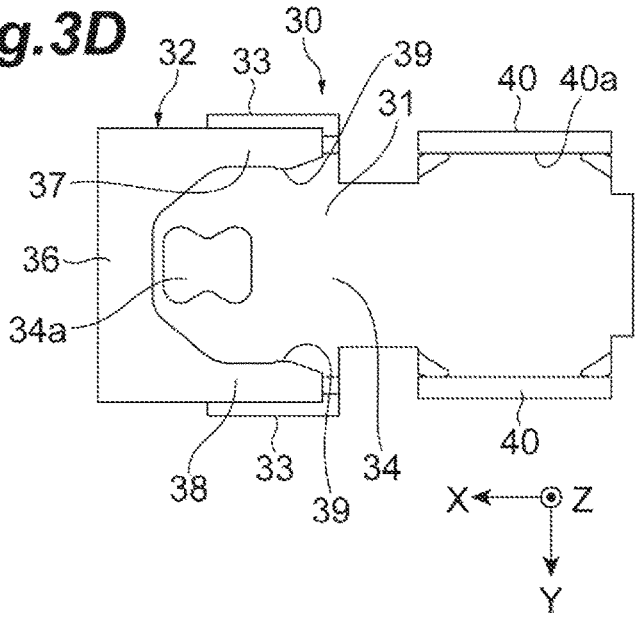

The guide portion 33 is provided integrally with the flat plate portion 34, as shown in FIG. 3A. The guide portions 33 are provided at both ends of the flat plate portion 34 in the Y direction and extend from a substantially central portion of the flat plate portion 34 toward a tip end thereof in the X direction. The guide portion 33 extends in the Z direction from the flat plate portion 34 toward the pair of arm portions 37 and 38 at both ends of the flat plate portion 34 in the Y direction. The guide portion 33 guides the movement of the restriction portion 32 in the X direction by sliding along the rail portion 11*e* in a state in which a contact surface 33*a* (refer to FIGS. 3A and 6B) which is an inner wall surface in the Y direction is in contact with the rail portion 11*e*. A pair of guide portions 33 and 33 slide along the rail portion 11*e* in a state in which the pair of guide portions 33 and 33 accommodate a pair of rail portions 11*e* and 11*e* of the outer conductor shell 11 and the lid portion 11*b* in a region partitioned with the flat plate portion 34.

(Positioning Portion)

As shown in FIG. 7B, the positioning portion 40 curbs the movement of the plug connector 10 in the connector width direction (the Y direction), in which the pair of arm portions 37 and 38 face each other, in a restricted state in which the pair of arm portions 37 and 38 restrict the expansion of the diameter of the fitting portion 11*a*. As shown in FIG. 3A, the positioning portion 40 is provided integrally with the flat plate portion 34. The positioning portion 40 is a plate-like piece which is provided at both ends of the flat plate portion 34 in the Y direction and extends in the X direction at a position closer to the rear of the guide portion 33 in the X direction. The positioning portions 40 extend downward from the flat plate portion 34 at both ends in the Y direction of the flat plate portion 34. As shown in FIG. 7A, an inner wall surface 40*a* of the positioning portion 40 is located inward in the Y direction from the outer wall surface 11*x* which is the outer surface of the rail portion 11*e* in the Y direction.

As shown in FIG. 7B, the positioning portion 40 faces the first fixing portion 11*p* of the plug connector 10 located rearward (outward) from the fitting portion 11*a* in the Y direction in the restricted state, and curbs the movement of the plug connector 10 (specifically, the first fixing portion 11*p*) in the Y direction. The positioning portion 40 is provided so that the inner wall surface 40*a* (a surface of the positioning portion 40 which faces the first fixing portion 11*p*) comes into contact with the first fixing portion 11*p* when the plug connector 10 moves in the Y direction, and thus curbs the movement of the plug connector 10 (specifically, the first fixing portion 11*p*) in the Y direction. Further, as shown in FIG. 7A, the positioning portion 40 may face the first fixing portion 11*p* in the Y direction even in the standby state and may curb the movement of the plug connector 10 (specifically, the first fixing portion 11*p*) in the Y direction.

In addition, the positioning portion 40 comes into contact with a part of the plug connector 10 when the locking member 30 moves in the X direction which is a moving direction and curbs the locking member 30 from further moving in the X direction. Specifically, as shown in FIG. 7A, for example, when the locking member 30 is sufficiently moved in a direction of the tip end of the plug connector 10 (the tip end in the X direction), the positioning portion 40 comes into contact with the connection portion 11*z* of the plug connector 10 (the portion which connects the outer wall surface 11*x* of the rail portion 11*e* to the outer wall surface 11*y* of the first fixing portion 11*p*), and thus the locking member 30 cannot move further in the direction of the tip end. Accordingly, when the locking member 30 is moved in switching between the restricted state and the standby state, separation of the locking member 30 from the plug connector 10 can be curbed.

Figure 4A:
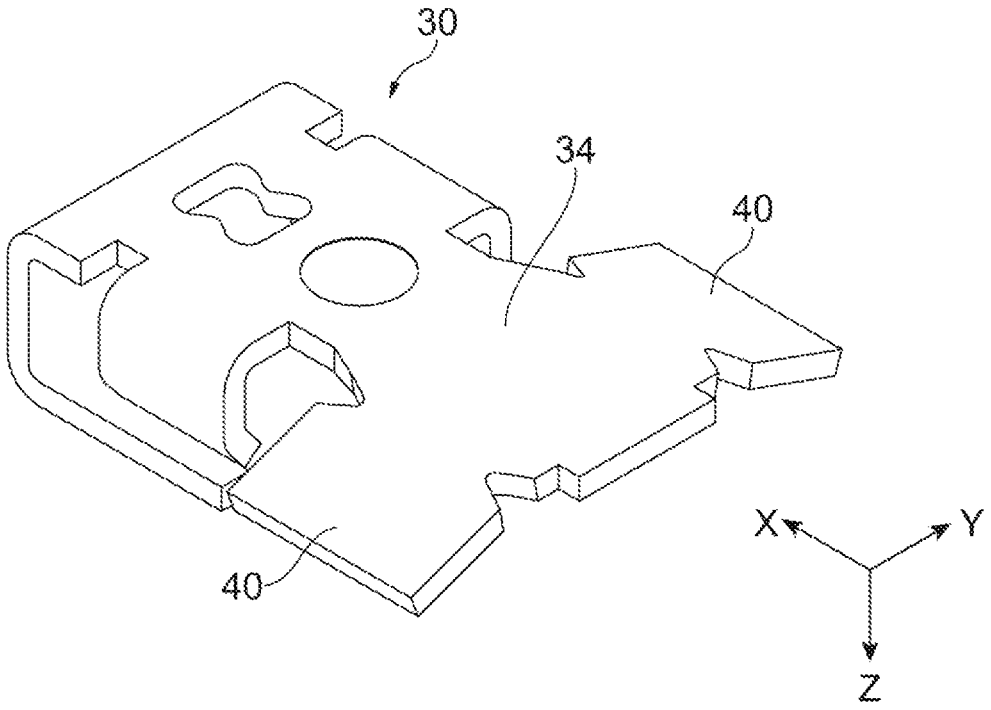
Figure 4B:
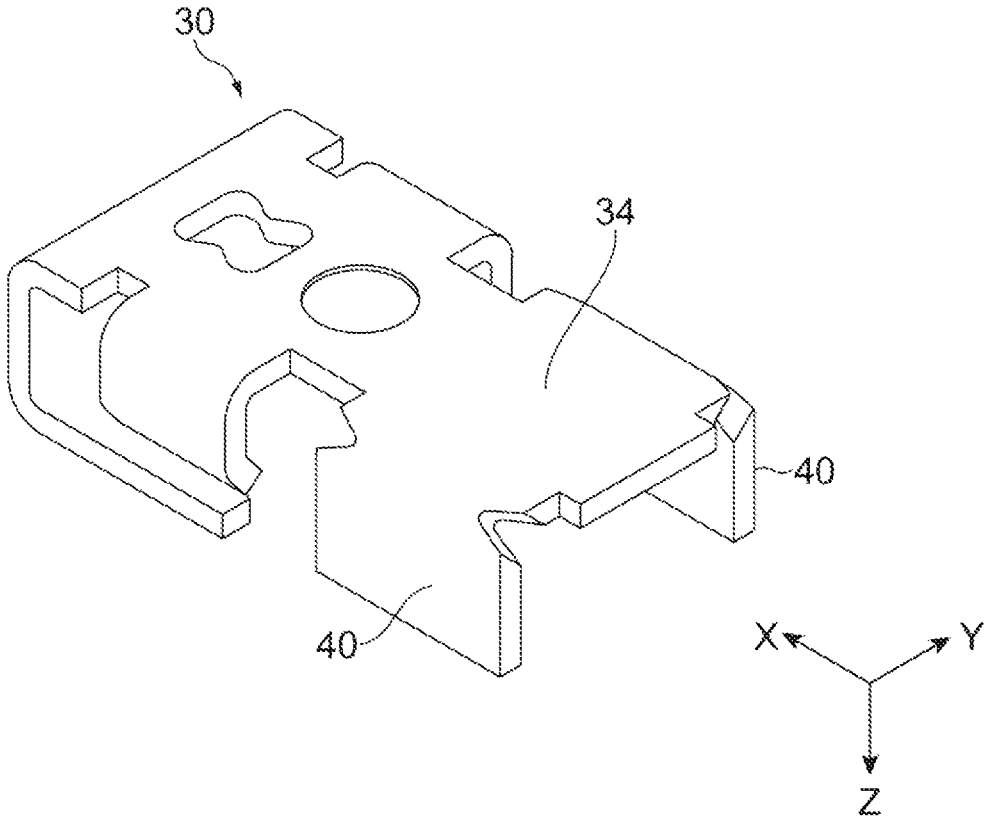

The positioning portion 40 extends in the Z direction (downward) from both ends of the flat plate portion 34 in the Y direction and is provided substantially perpendicular to the flat plate portion 34 in a state in which the locking member 30 is mounted on the plug connector 10, as shown in FIG. 4B, but is provided substantially parallel to the flat plate portion 34 (specifically, slightly bent downward) when the locking member 30 is mounted on the plug connector 10, as shown in FIG. 4A. That is, when the locking member 30 is mounted on the plug connector 10, the locking member 30 before the positioning portion 40 is bent may be mounted on the plug connector 10, as shown in FIG. 4A, and then the positioning portion 40 may be bent after the mounting, as shown in FIG. 4B.

[Details of Electrical Connector]

Figure 5B:
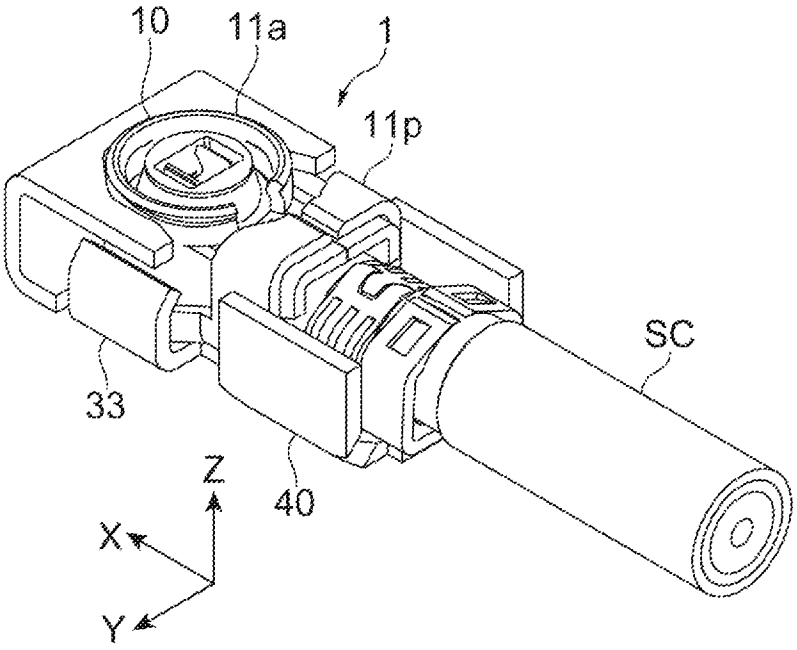
Figure 5A:
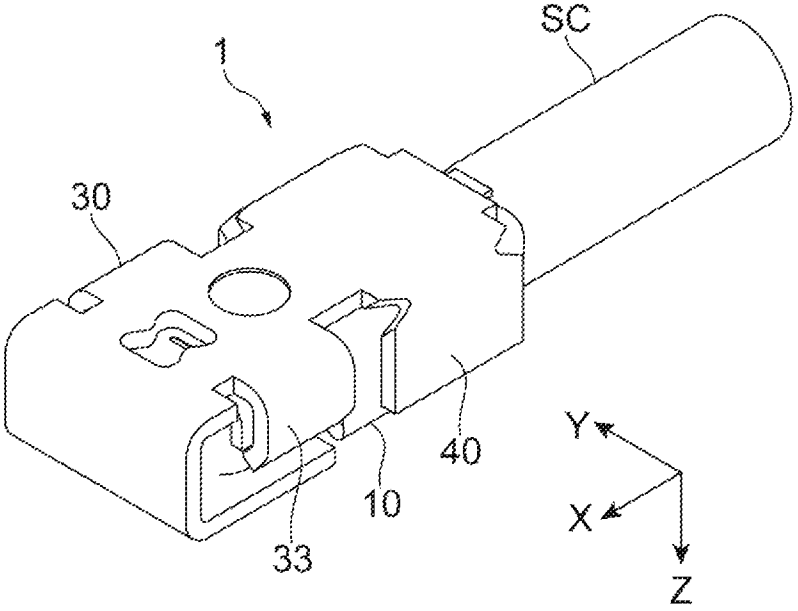

Next, details of the electrical connector 1 including the plug connector 10 on which the locking member 30 is mounted will be described with reference to FIGS. 5 to 7. As shown in FIG. 6B, in the state in which the locking member 30 is mounted on the plug connector 10, the flat plate portion 34 of the main body portion 31 is in contact with the lid portion 11*b* to cover the lid portion 11*b* of the outer conductor shell 11. Further, in the state in which the contact surface 33*a* of the guide portion 33 is in contact with the rail portion 11*e*, the guide portion 33 is slidable along the rail portion 11*e*. Additionally, as shown in FIGS. 7A and 7B, the positioning portion 40 of the locking member 30 faces the first fixing portion 11*p* in the Y direction in both the restricted state and the standby state.

In the standby state shown in FIG. 7A, the diameter of the fitting portion 11*a* can be expanded. In the standby state, the electrical connector 1 is fitted to the receptacle connector 100 by expanding the diameter of the fitting portion 11*a* (details will be described later). On the other hand, in the restricted state shown in FIG. 7B, the fitting portion 11*a* is disposed between the pair of arm portions 37 and 38, and the fitting portion 11*a* is not allowed to be expanded by the pair of arm portions 37 and 38. Since the electrical connector 1 is brought into the restricted position state after the locking member 30 is fitted to the receptacle connector 100 in the above-described standby position state, and thus the outer diameter of the fitting portion 11*a* is not expanded, the fitted state with respect to the receptacle connector 100 is firmly maintained (details will be described later).

Subsequently, a configuration for causing the operator to sense the switching (change) of the state (the standby state or the restricted state) of the locking member 30 will be described in detail. As shown in FIGS. 7A and 7B, the distance between the pair of arm portions 37 and 38 at the positions in which the protruding portions 39 are provided is shorter than the outer diameter of the fitting portion 11*a*. Thus, when the standby state shown in FIG. 7A is transitioned to the restricted state shown in FIG. 7B, the portions of the pair of arm portions 37 and 38 in which the protruding portions 39 are provided need to get over the fitting portion 11*a* having an outer diameter larger than the distance between the pair of arm portions 37 and 38. When the protruding portions 39 get over the fitting portion 11*a*, the operator who operates the locking member 30 can get a feeling of getting over (vibration) or a sound when getting over, that is, a so-called click feeling. Due to such a click feeling, the switching (the change) of the state of the locking member 30 (the standby state or the restricted state) can be sensed by the worker.

Next, a configuration for preventing the electrical connector 1 from coming off will be described in detail. In the electrical connector 1, the positioning portion 40 is provided as a stopper structure so that the locking member 30 does not come off the plug connector 10. As shown in FIGS. 5A and 5B and FIGS. 7A and 7B, the positioning portion 40 is provided to face the first fixing portion 11*p* in the Y direction in both the restricted state and the standby state and is provided so that the inner wall surface 40*a* (the surface of the positioning portion 40 which faces the first fixing portion 11*p*) comes into contact with the first fixing portion 11*p* when the plug connector 10 moves in the Y direction. With such a configuration, movement of the plug connector 10 (specifically, the first fixing portion 11*p*) in the Y direction is curbed, and thus separation of the locking member 30 from the plug connector 10 is curbed. Further, in the electrical connector 1, as shown in FIG. 7A, for example, when the locking member 30 is sufficiently moved in the direction of the tip end (the tip end in the X direction) of the plug connector 10, the positioning portion 40 comes into contact with the connection portion 11*z* of the plug connector 10 (the portion which connects the outer wall surface 11*x* of the rail portion 11*e* to the outer wall surface 11*y* of the first fixing portion 11*p*), and thus the locking member 30 cannot move further in the direction of the tip end. Accordingly, when the locking member 30 is moved in the switching between the restricted state and the standby state, the separation of the locking member 30 from the plug connector 10 can be curbed.

[Fitting and Locking of Electrical Connector]

Next, with reference to FIG. 1 and FIG. 8, fitting between the plug connector 10 and the receptacle connector 100 and locking after the fitting will be described in detail.

As shown in FIG. 1, the receptacle connector 100 has the signal contact member 102 and the ground contact member 103. The receptacle connector 100 is mounted on the printed wiring board 200 by, for example, soldering. The receptacle connector 100 is fitted to the plug connector 10 mounted on the coaxial cable SC. The signal contact member 102 is a signal transmission conductor formed of, for example, a thin metal member. At least a part of the signal contact member 102 protrudes outward from an opening of the housing in a state in which the signal contact member 102 is accommodated in the housing. The signal contact member 102 is electrically connected to the inner conductor SC1 by being in contact with the inner conductor contact 13 of the plug connector 10, as shown in FIG. 8C. The ground contact member 103 is a member which is connected to the ground terminal 202 of the printed wiring board 200 formed of, for example, a thin metal member and foul's a part of a ground circuit. The ground contact member 103 is disposed to annularly surround the signal contact member 102 and the outside of the housing. The concave portion 103*a* (refer to FIGS. 1 and 8C) which is recessed inward in the radial direction is formed over the entire periphery on the outer peripheral surface of the ground contact member 103. The concave portion 103*a* is an engagement portion with the protruding portion 11*e* (refer to FIG. 8C) formed on the fitting portion 11*a* of the plug connector 10.

When the plug connector 10 and the receptacle connector 100 are fitted, the locking member 30 is in the standby state (refer to FIG. 7A). In this case, the diameter of the fitting portion 11*a* can be expanded. In this state, the plug connector 10 is fitted to the receptacle connector 100 while the diameter of the fitting portion 11*a* is expanded. Specifically, as shown in FIG. 8C, the ground contact member 103 of the receptacle connector 100 is inserted into a space between the fitting portion 11*a* of which the diameter has been expanded and the insulating housing 12.

In the inserted state, the protruding portion 11*c* of the fitting portion 11*a* and the concave portion 103*a* of the ground contact member 103*a*re engaged, and the plug connector 10 and the receptacle connector 100 are fitted to each other. In the fitted state, the inner conductor contact 13 of the plug connector 10 is in contact with the signal contact member 102 of the receptacle connector 100. The fitting portion 11*a* can be inserted into and removed from the ground contact member 103 only after the diameter is expanded and cannot be inserted into or removed from the ground contact member 103 in the state in which the diameter is not expanded.

When the fitting state is firmly maintained (locked) after the fitting, the guide portion 33 of the locking member 30 is slid along the rail portion 11*e* to be in the restricted state as shown in FIG. 8D. In this case, the fitting portion 11*a* is disposed between the pair of arm portions 37 and 38, and the diameter thereof cannot be expanded. As described above, the fitting portion 11*a* cannot be inserted into or removed from the ground contact member 103 in the state in which the diameter is not expanded. Therefore, since the diameter of the fitting portion 11*a* cannot be expanded after the fitting, the fitting portion 11*a* cannot be inserted or removed, and the fitted state between the plug connector 10 and the receptacle connector 100 can be maintained firmly.

[Method for Manufacturing Electrical Connector]

Next, a method for manufacturing the electrical connector 1 (a method of mounting the locking member 30 on the plug connector 10) will be described. The method for manufacturing the electrical connector 1 includes a first step of mounting the locking member 30 on the plug connector 10, and a second step of bending the positioning portion 40 so that the positioning portion 40 faces the first fixing portion 11*p* in the Y direction after the first step. More specifically, in the first step, the locking member 30 is mounted on the plug connector 10 in a state before the bending in which the positioning portion 40 is substantially parallel to the flat plate portion 34 (specifically, a state in which the positioning portion 40 is slightly bent downward), as shown in FIG. 4A, and, in the second step, the positioning portion 40 is bent as shown in FIG. 4B.

[Operation and Effect]

Next, the operation and effect of the electrical connector 1 will be described.

The electrical connector 1 according to the embodiment includes the plug connector 10 mounted on the tip end of the coaxial cable SC, and the locking member 30 mounted on the plug connector 10, and the plug connector 10 includes the conductive outer conductor shell 11 which is electrically connected to the ground contact member 103 of the receptacle connector 100. The outer conductor shell 11 has the cylindrical fitting portion 11*a* which is fitted to the ground contact member 103, the outer diameter of the fitting portion 11*a* is configured to be able to be expanded when it is inserted into and removed from the ground contact member 103, and the locking member 30 includes the pair of arm portions 37 and 38 which restrict the expansion of the diameter of the fitting portion 11*a* by sandwiching the fitting portion 11*a* from outward in the radial direction when the fitting portion 11*a* fitted to the ground contact member 103 is removed, and the positioning portion 40 which curbs the movement of the plug connector 10 in the Y direction, in which the pair of arm portions 37 and 38 face each other, in the restricted state in which the pair of arm portions 37 and 38 restricts the expansion of the diameter of the fitting portion 11*a*. In the restricted state, the positioning portion 40 faces the first fixing portion 11*p* located rearward from the fitting portion 11*a*, which is a direction from the tip end of the cable toward the base end of the cable, in the Y direction, and curbs the movement of the first fixing portion 11*p* in the Y direction.

In such an electrical connector 1, the pair of arm portions 37 and 38 of the locking member 30 are configured to be able to restrict the expansion of the outer diameter of the fitting portion 11*a*. Therefore, the expansion of the diameter of the fitting portion 11*a* after fitting with the receptacle connector 100 is curbed, and the fitted state between the plug connector 10 and the receptacle connector 100 can be firmly maintained. Further, in the electrical connector 1, in the restricted state in which the expansion of the diameter of the fitting portion 11*a* is restricted, the positioning portion 40 of the locking member 30 faces the first fixing portion 11*p* in the Y direction and curbs the movement of the first fixing portion 11*p* in the Y direction. The separation of the locking member 30 from the plug connector 10 can be curbed by curbing the movement of the first fixing portion 11*p*. Additionally, conventionally, the movement of the plug connector 10 in the Y direction has been curbed by extending the pair of arm portions 37 and 38 (having an extending portion in addition to a portion which restricts the expansion of the diameter). However, in the electrical connector 1, such an extending portion is not provided, and the positioning portion 40 which faces the first fixing portion 11*p* is provided as a configuration different from the pair of arm portions 37 and 38. Since the extending portions of the pair of arm portions 37 and 38 which has conventionally been required are not provided, the configuration around the pair of arm portions 37 and 38 can be simplified, and a size of the locking member 30 can be reduced. Further, in the above-described configuration in which the cantilever-like extending portion is provided, the extending portion may be damaged in operation of the locking member, but strength can be improved, and breakage can be curbed by providing the positioning portion 40 without providing the above-described extending portion as in the electrical connector 1 according to the embodiment.

Further, since a rear portion which faces the positioning portion 40 is a fixing portion (the first fixing portion 11*p*) which is made of a metal and fixes the plug connector 10 to the coaxial cable SC, for example, the positioning portion 40 of the locking member 30 made of a metal or the like and the first fixing portion 11*p* made of a metal face each other, and it is possible to secure a contact strength when the positioning portion 40 is in contact with the first fixing portion 11*p* to correct a position of the first fixing portion 11*p* (to curb the movement of the plug connector 10 in the Y direction).

The locking member 30 may be mounted on the plug connector 10 to allow mutual movement between a position in the restricted state and a position in the standby state in which the pair of arm portions 37 and 38 do not restrict the expansion of the diameter of the fitting portion 11*a*, and the positioning portion 40 may come into contact with a part of the plug connector 10 (specifically, the connection portion 11*z*) when the locking member 30 moves in the moving direction and may curb further movement of the locking member 30 in the moving direction. Thus, when the locking member 30 is moved in the switching between the restricted state and the standby state, the separation of the locking member 30 from the plug connector 10 can be curbed.

The positioning portion 40 may face the first fixing portion 11*p* in the Y direction even in the standby state in which the pair of arm portions 37 and 38 do not restrict the expansion of the diameter of the fitting portion 11*a* and may curb the movement of the first fixing portion 11*p* in the Y direction. According to such a configuration, the separation of the locking member 30 from the plug connector 10 can be curbed in both the restricted state and the standby state.

The locking member 30 may be mounted on the plug connector 10 to allow mutual movement between the position in the restricted state and the position in the standby state in which the pair of arm portions 37 and 38 do not restrict the expansion of the diameter of the fitting portion 11*a*, and in the position of the standby state, the tip ends of the pair of arm portions 37 and 38 may not go beyond the center of the fitting portion 11*a* in the moving direction of the locking member 30. According to such a configuration, when compared with a conventional configuration in which the pair of arm portions extend rearward (the configuration having the extending portion), the length of the pair of arm portions 37 and 38 is reduced, and the size of the locking member 30 can be reduced.

The locking member 30 is mounted on the plug connector 10 to allow mutual movement between the position in the restricted state and the position in the standby state in which the pair of arm portions 37 and 38 do not restrict the expansion of the diameter of the fitting portion 11*a*, the plug connector 10 has the rail portion 11*e* which extends in the moving direction of the locking member 30 and assists the movement of the locking member 30, and the inner wall surface 40*a* which is a surface of the positioning portion 40 facing the first fixing portion 11*p* is located more inward in the Y direction from the outer wall surface 11*x* which is an outer surface of the rail portion 11*e* in the Y direction. According to such a configuration, the positioning portion 40 can be provided near the first fixing portion 11*p* (close to the first fixing portion 11*p*) in the Y direction, and the movement of the first fixing portion 11*p* in the Y direction can be more effectively curbed.

The method for manufacturing the electrical connector 1 according to the embodiment includes the first step of mounting the locking member 30 on the plug connector 10, and a second step of bending the positioning portion 40 so that the positioning portion 40 faces the first fixing portion 11*p* in the Y direction after the first step. For example, in the case in which the locking member of which the positioning portion is bent from the beginning is mounted on the plug connector, in order to be able to be mounted, it is necessary for the positioning portion (or the periphery thereof) to have a sufficient spring characteristics to allow, for example, outward displacement. However, the locking member having good spring characteristics may come off the plug connector when, for example, a strong external force is applied. On the other hand, in the case in which the positioning portion 40 is bent after the locking member 30 is mounted on the plug connector 10 to form a structure in which the locking member 30 does not come off, as in the above-described manufacturing method, since it is not necessary to use the locking member having the good spring characteristics as described above, it is possible to curb the coming-off of the locking member 30 from the plug connector 10 even when an external force or the like is applied.

What is claimed is:

1. An electrical connector comprising:

a first connector mounted on a tip end of a cable and including a conductive contact configured to be electrically connected to a mating contact of a second connector, wherein the conductive contact includes a cylindrical fitting portion, and wherein an outer diameter of the fitting portion is configured to expand when the fitting portion is connected to or removed from the mating contact; and a locking member mounted on the first connector and including:

a pair of arm portions configured to restrict an expansion of the outer diameter of the fitting portion, in a restricted state, by sandwiching the fitting portion in a radial direction in which the pair of arm portions face each other after the fitting portion has been connected to the mating contact of the second connector; and a positioning portion configured to restrict a movement of the first connector in the radial direction when the pair of arm portions sandwich the fitting portion, the first connector including a rear portion located rearward from the fitting portion toward a base end of the cable opposite the tip end, wherein the positioning portion faces the rear portion of the first connector in the radial direction, in the restricted state, in order to restrict the movement of the rear portion in the radial direction, and wherein the locking member is configured to move relative to the first connector in a moving direction between a first position associated with the restricted state and a second position associated with a standby state in which the pair of arm portions do not restrict the expansion of the outer diameter of the fitting portion, the first connector has a rail portion configured to assist the movement of the locking member in the moving direction, and a surface of the positioning portion which faces the rear portion of the first connector is located inward from an outer surface of the rail portion in the radial direction.

2. The electrical connector according to claim 1, wherein the rear portion is made of a metal and is configured to fix the first connector to the cable.

3. The electrical connector according to claim 1, wherein the positioning portion is configured to contact the first connector when the locking member moves in the moving direction in order to restrict the movement of the locking member in the moving direction.

4. The electrical connector according to claim 1, wherein the positioning portion faces the rear portion in the radial direction in the standby state in which the pair of arm portions do not restrict the expansion of the outer diameter of the fitting portion.

5. The electrical connector according to claim 1, wherein the pair of arm portions include ends that, in the standby state, do not go beyond a center of the fitting portion in the moving direction.

6. A method for manufacturing the electrical connector according to claim 1, comprising:

mounting the locking member on the first connector; and bending the positioning portion so that the positioning portion faces the rear portion in the radial direction after mounting the locking member on the first connector.

7. A locking member mounted on a first connector of a cable, comprising:

a pair of arm portions configured to restrict expansion of an outer diameter of a cylindrical fitting portion of the first connector, in a restricted state, by sandwiching the fitting portion in a radial direction in which the pair of arm portions face each other after the fitting portion of the first connector has been fitted to a mating contact of a second connector; and a positioning portion configured to restrict a movement of the first connector in the radial direction when the pair of arm portions sandwich the fitting portion, the first connector including a rear portion located rearward from the fitting portion toward a base end of the cable, wherein the positioning portion faces the rear portion of the first connector in the radial direction, in the restricted state, in order to restrict the movement of the rear portion in the radial direction, and wherein the locking member is configured to move relative to the first connector in a moving direction between a first position associated with the restricted state and a second position associated with a standby state in which the pair of arm portions do not restrict the expansion of the outer diameter of the fitting portion, the first connector has a rail portion configured to assist the movement of the locking member in the moving direction, and a surface of the positioning portion which faces the rear portion of the first connector is located inward from an outer surface of the rail portion in the radial direction.

8. The locking member according to claim 7, wherein the rear portion is made of a metal and is configured to fix the first connector to the cable.

9. The locking member according to claim 7, wherein the positioning portion is configured to contact the first connector when the locking member moves in the moving direction in order to restrict a movement of the locking member in the moving direction.

10. The locking member according to claim 7, wherein the positioning portion faces the rear portion in the radial direction in the standby state in which the pair of arm portions do not restrict the expansion of the outer diameter of the fitting portion.

11. The locking member according to claim 7, wherein the pair of arm portions include ends that, in the standby state, do not go beyond a center of the fitting portion in the moving direction.

12. The locking member according to claim 7, further comprising:

a flat plate portion overlapping the fitting portion, wherein the pair of arm portions face the flat plate portion in a fitting direction of the first connector and the second connector; and a pair of guide portions which extend in the fitting direction from opposite sides of the flat plate portion toward the pair of arm portions.

13. The locking member according to claim 12, wherein the positioning portion include a pair of positioning portions which extend in the fitting direction from the opposite sides of the flat plate portion.

14. The locking member according to claim 13, wherein the pair of arm portions extend in the axial direction of the cable to at least partial overlap the pair of guide portions in the fitting direction, but do not extend sufficiently rearward in the axial direction of the cable to overlap the pair of positioning portions.

15. The locking member according to claim 12, wherein a lid portion of the first connector is located between the flat plate portion and the fitting portion, the lid portion enclosing one end of the fitting portion.

16. The locking member according to claim 7, wherein the positioning portion is configured to abut against the first connector when the locking member moves in the moving direction.

17. An electrical connector comprising:

a first connector mounted on a tip end of a cable and including a conductive contact configured to be electrically connected to a mating contact of a second connector, wherein the conductive contact includes a cylindrical fitting portion and a lid portion enclosing one end of the fitting portion, and wherein an outer diameter of the fitting portion is configured to expand when the fitting portion is connected to or removed from the mating contact; and a locking member mounted on the first connector and including:

a flat plate portion configured to cover the lid portion;

a pair of arm portions which face the flat plate portion in a fitting direction of the first connector and the second connector and are configured to extend in an axial direction of the cable parallel to the flat plate portion;

a pair of guide portions which extend from opposite sides of the flat plate portion toward the pair of arm portions in the fitting direction; and a pair of positioning portions which extend in the fitting direction from the opposite sides of the flat plate portion so as to face each other, the pair of positioning portions located rearward from the pair of guide portions in the axial direction of the cable, wherein the pair of arm portions extend in the axial direction of the cable to at least partially overlap the pair of guide portions in the fitting direction but do not extend sufficiently rearward in the axial direction of the cable to overlap the pair of positioning portions, the pair of arm portions configured to restrict an outward expansion of a diameter of the fitting portion by sandwiching the fitting portion in a radial direction during removal of the fitting portion from the mating contact of the second connector, the pair of positioning portions face a rear portion of the first connector to prevent a movement of the rear portion in the radial direction in a restricted state in which the pair of arm portions restrict the outward expansion of the diameter of the fitting portion, the rear portion located rearward from the fitting portion in the axial direction of the cable, the locking member is mounted on the first connector so as to enable selective movement in a moving direction between a position in the restricted state in which the expansion of the diameter of the fitting portion is restricted and a position in a standby state in which the expansion of the diameter of the fitting portion is not restricted by the pair of arm portions, and the pair of positioning portions are configured to abut against the first connector when the locking member moves in the moving direction and to prevent the locking member from moving further in the moving direction.

18. The electrical connector according to claim 17, wherein the first connector has a rail portion configured to assist the movement of the locking member in the moving direction, and a surface of the pair of positioning portions which faces the rear portion of the first connector is located inward from an outer surface of the rail portion in the radial direction.

19. The electrical connector according to claim 18, wherein the pair of positioning portions face the rear portion in the radial direction in the standby state.

20. The electrical connector according to claim 17, wherein the pair of arm portions include ends that, in the standby state, do not go beyond a center of the fitting portion in the moving direction.

* * * * *